United States Patent [19]

Washida et al.

[11] 4,366,413

[45] Dec. 28, 1982

[54] SECONDARY ELECTRON MULTIPLICATION TARGET

[75] Inventors: Hiroshi Washida; Kensaku Yano, both of Yokohama; Yoshio Yamaoka, Kawasaki, all of Japan

[73] Assignee: Tokyo Shibaura Denki Kabushiki Kaisha, Kawasaki, Japan

[21] Appl. No.: 197,745

[22] Filed: Oct. 16, 1980

[30] Foreign Application Priority Data

Oct. 18, 1979 [JP] Japan ..... 54-133525

[51] Int. Cl.[3] ..... H01J 31/48

[52] U.S. Cl. ..... 313/377; 313/107

[58] Field of Search ..... 313/377, 376, 103 R

[56] References Cited

U.S. PATENT DOCUMENTS

| | | | |
|---|---|---|---|
| 2,909,687 | 10/1959 | Turk et al. | 313/376 |
| 3,061,752 | 10/1962 | Banks | 313/376 |
| 3,534,207 | 10/1970 | Blamoutier et al. | 313/377 |
| 3,546,514 | 12/1970 | Blamoutier | 313/376 X |
| 3,657,596 | 4/1972 | Goetze et al. | 313/103 X |

FOREIGN PATENT DOCUMENTS

| | | |
|---|---|---|
| 4227503 | 5/1965 | Japan . |
| 47-36926 | 9/1972 | Japan . |

OTHER PUBLICATIONS

McMullan et al., Reprinted from Electronics Letters, vol. 4, #17, Aug. 23, 1968; "Stable SEC Target for Television Camera Tubes".

*Primary Examiner*—Robert Segal

*Attorney, Agent, or Firm*—Cushman, Darby & Cushman

[57] ABSTRACT

A secondary electron multiplication target includes first and second porous layers laminated on a signal electrode. The first porous layer is formed of $MgF_2$ which, having a high secondary electron emitting ratio and a dielectric constant of 6 or less, produces a great number of secondary electrons in response to photoelectrons incident thereupon across the signal electrode. The second porous layer is formed of carbon which has a low secondary electron emitting ratio and hence a high crossover potential, as well as a dielectric constant of 6 or less.

4 Claims, 5 Drawing Figures

SECONDARY ELECTRON MULTIPLICATION TARGET

This invention relates to a secondary electron multiplication target for a secondary electron conduction type vidicon.

An early secondary electron conduction type vidicon (SEC vidicon as it is called) is described in U.S. Pat. No. 3,213,316 by G. Goetze, for example. In such early-type SEC vidicon, a suppressing mesh electrode is provided between a target and a field mesh electrode. The suppressing mesh electrode is intended to keep the surface of the target scanned with an electron beam emitted from an electron gun below a first crossover potential which depends on the material of a secondary electron emitting porous layer of the target, thereby preventing the potential of the target surface from increasing above the first crossover potential to break the target. As stated in Japanese Patent Publication No. 27503/67 and its corresponding U.S. patent application Ser. No. 457,430 filed on May 20, 1965, however, it is revealed that the SEC vidicon with the suppressing mesh electrode is complicated in construction due to the location of the mesh electrode, involving various problems such as deterioration of picture quality or resolution as well as an increase of related equipments. In order to solve these problems, proposals on the improvements of the target are disclosed in the aforementioned Japanese Patent Publication No. 27503/67 and another Japanese Patent Publication No. 36926/72 and its corresponding U.S. patent application Ser. No. 776,553 filed on Nov. 18, 1968, as well as in "Stable SEC Target for Television Camera Tubes" by D. Mcmullan and G. O. Towler, Electronics Letters Vol. 14, No. 17, issued on Aug. 23, 1968. According to these proposals, the electron-beam scanning surface of the target is coated with a material with a low secondary electron emitting ratio so that the first crossover potential of the electron-beam scanning surface may be increased to prevent breakdown of the target. In the aforesaid Japanese Patent Publication No. 36926/72 related to an improvement of the Japanese Patent Publication No. 27503/67, it is described that a first crossover potential of approximately 35 V can be applied to the electron-beam scanning surface of the target which is coated by a discontinuous layer of aluminum or gold. According to an experiment conducted by the inventors hereof, however, it is found to be difficult perfectly to prevent the breakdown of the target by only applying the first crossover potential of 35 V or thereabouts to the scanning surface of the target. In the "Stable SEC Target for Television Camera Tubes," there is disclosed a target using KCl for the secondary electron emitting porous layer and having porous ZnS layer on the porous KCl layer. Although it is stated that, according to such target, a first crossover potential of 90 V can be applied to the electron-beam scanning surface, it is confirmed that the crossover potential will actually be reduced by alkaline metal generated in the manufacturing step of photocathodes of SEC vidicons.

Moreover, the inventors hereof recognized that even if a sufficiently high first crossover potential can be applied to the electron-beam scanning surface, the secondary electron emitting porous layer will shrink and cohere to change the characteristics of the target. Various experiments revealed that the shrinkage of the porous layer is caused by Coulomb's force applied to the porous layer by an electric field which is given to the layer while the SEC vidicon is operating.

An object of this invention is to provide a secondary electron multiplication target for a secondary electron conduction type vidicon, having its target protected against breakdown and shrinkage.

According to the invention, there is provided a secondary electron multiplication target for a secondary electron conduction vidicon, comprising a platelike signal electrode formed of a conductive material, whereby secondary electrons are taken out, a first porous layer deposited on one side of the signal electrode and formed of a material with a relatively high secondary electron emitting ratio and a dielectric constant of 6 or less, whereby a great number of secondary electrons are emitted in response to photoelectrons transmitted thereto through the signal electrode, and a second porous layer deposited on the first porous layer and formed of a material with a low secondary electron emitting ratio and a dielectric constant of 6 or less.

This invention can be more fully understood from the following detailed description when taken in conjunction with the accompanying drawings, in which.

Figure 1:
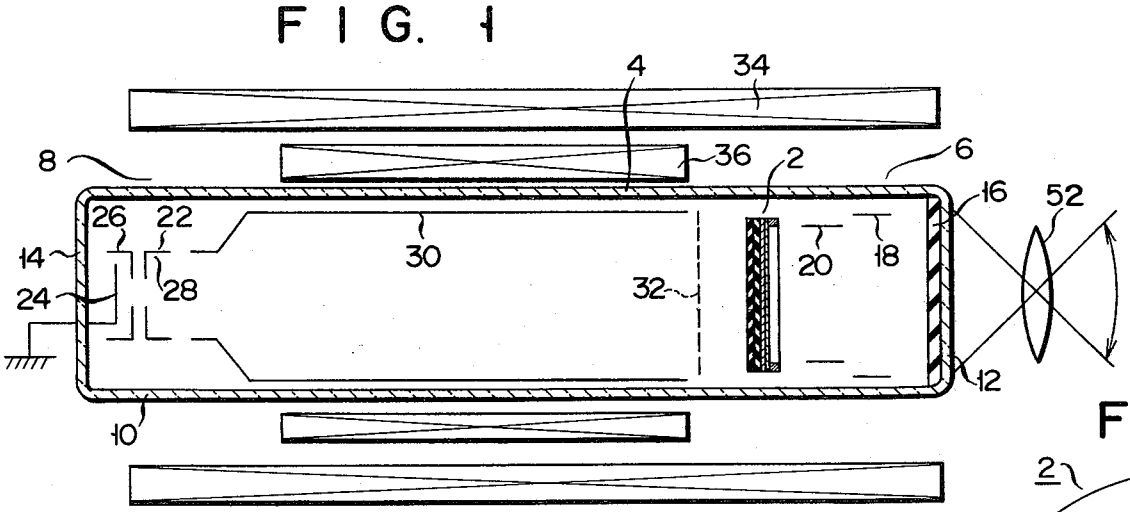
FIG. 1 is a schematic sectional view of a secondary electron conduction type vidicon incorporating a secondary electron multiplication target of this invention.

Referring now to the drawing of FIG. 1, there is schematically shown a SEC vidicon incorporating a secondary electron multiplication target 2 according to an embodiment of this invention. The SEC vidicon is provided with a vacuum envelope 4 the interior of which is divided by the target 2 into an image section 6 and a scanning section 8. The vacuum envelope 4 is composed of a tubular glass portion 10, a transparent face plate 12, and a stem portion 14. In the image section 6, there is a photocathode 16 which produced photoelectrons in accordance with the intensity of light incident upon the inner surface of the face plate 12. Between the photocathode 16 and the target 2, there are disposed two electrodes 18 and 20 for accelerating the movement of the photoelectrons from the photocathode 16. In the scanning section 8, an electron gun 22 including a cathode electrode 24, a control electrode 26, and an acceleration electrode 28 and producing an electron beam is attached to the stem portion 14. Between the electron gun 22 and the target 2, there are disposed a focussing electrode 30 for converging the electron beam from the electron gun 22 and a field mesh electrode 32 for landing the electron beam at a predetermined position in the surface of the target 2. Outside the vacuum envelope 4, there is disposed a focussing coil 34 for converging the electron beam and a deflecting coil 36 for deflecting the electron beam.

Figure 2:
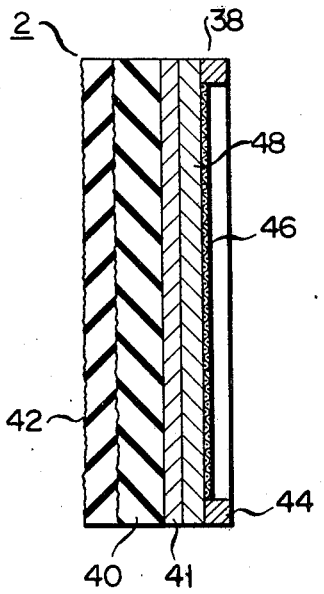
FIG. 2 is a schematic sectional view of a secondary electron multiplication target according to an embodiment of the invention.

As shown in FIG. 2, the SEC target 2 is composed of a member 38 for supporting the target, a platelike signal electrode 41 for taking out signal charges supported by the member 38, a first porous layer 40 emitting secondary electrons in response to photoelectrons applied thereto, and a second porous layer 42 covering the first porous layer 40 and keeping the crossover potential of the electron beam scanning surface of the target 2 high. The member 38, which is of a mesh support type as it is called, is formed by stretching a metal mesh 46 across a metal ring 44 and covering the metal mesh 46 with a conductive this film 48 of aluminium or gold. The mesh support type member 38 may be replaced by a conventional target supporting member which is formed by simply stretching the conductive thin film 48 of aluminium or gold across the metal ring 44. Although a little poorer in photoelectron permeability, the mesh support type member 38 is higher in strength and thermal conductivity as compared with the conventional member. Therefore, the influence of heat generated by high-intensity incident light may be reduced, and a satisfactory load characteristic can be obtained. The first porous layer 40 is formed of a material with a high secondary electron emitting ratio and a dielectric constant of 6 or less, e.g., magnesium fluoride ($MgF_2$). The second porous layer 42 is formed of a material with a low secondary electron emitting ratio and a dielectric constant of 6 or less, e.g., carbon C.

The following is the reason why the materials of the first and second porous layers 40 and 42 are selected in the aforesaid manner. Evidently, the first porous layer 40 must produce a great number of secondary electrons in response to the incident photoelectrons. Materials to fulfill such requirement include MgO, KCl, $MgF_2$, $CaF_2$, $SrF_2$, etc. On the other hand, the second porous layer 42 must have a sufficiently low secondary electron emitting ratio because production of a great number of secondary electrons caused by electrons applied thereto will lead to a breakdown of the target. Materials to fulfill such requirement include carbon, metals, etc. Moreover, it is necessary that the target 2 should not be shrunk by an electric field generated in the target 2. Namely, voltage $V_T$ is applied between the electron beam scanning surface of the target 2 and the signal electrode 41 of the target 2 while the SEC vidicon is operating, and the first and second layers 40 and 42 are subjected to Coulomb's force F as follows. In order not to change the characteristic of the target, it is necessary that the first and second layers 40 and 42 stand the Coulomb's force F, having their thicknesses unchanged by the Coulomb's force F.

$$F = \frac{\epsilon' \cdot S \cdot V_T 2}{2d2}$$

here $\epsilon'$: Dielectric constant of porous layer,

S: Area of porous layer, d2: Thickness of porous layer.

Figure 3:
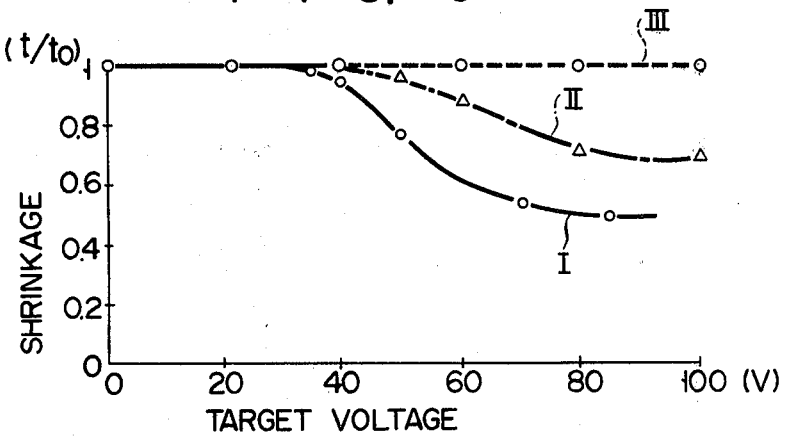
FIG. 3 is a graph for illustrating the relationship between the target voltage and the degree of shrinkage for various target materials.

As is evident from the above equation, the Coulomb's force F depends on the dielectric constant $\epsilon'$. Accordingly, if the mechanical strength of the porous layer is substantially constant, the Coulomb's force F will be able to be made small enough to prevent shrinkage of the porous layer by fully reducing the dielectric constant $\epsilon'$. The graph of FIG. 3 shows the relationship between the target voltage $V_T$ and the degree of shrinkage of the target, that is, the ratio between the initial thickness $t_o$ and the thickness t obtained after shrinkage, for various target materals. Curves I and II represent MgO porous layer and ZnS porous layer, respectively, while curve III represents $MgF_2$ porous layer, KCl porous layer and a double porous layer structure of $MgF_2$ and C. It is generally known that the dielectric constant of MgO is 9.65, ZnS 8.2, KCl 4.64, $MgF_2$ 4.87, and C 5.4 to 5.6 As above mentioned result it is sufficient for preventing the target from shrinkage to make the target from the material of which dielectric constant $\epsilon'$ is substantially 6 or less. In consideration of these requirements for the prevention of shrinkage, the first and second porous layers are preferably formed of $MgF_2$ and C, respectively. Although satisfying the aforesaid requirements, KCl is not desirable because it is subject to various problems as stated in U.S. Pat. No. 4,131,820.

Now there will be described a method for manufacturing the above-mentioned SEC target 2. The copper mesh 46 of e.g. 1,000 meshes/inch is stretched across the metal ring 44 formed of nichrome and titanium. An organic thin film of e.g. nitrocellulose is stretched over the copper mesh 46, and aluminum and silver are put on the thin film to thicknesses of 500 Å and 20 Å, respectively, by evaporation. Thereafter, the resultant structure is calcined at 400° C. in an inert gas atmosphere such as nitrogen, the nitrocullulose film is transpired, and the aluminium layer is filled into the meshes of the copper mesh 46 to form the mesh support type member 38. The member 38 is located in a vacuum belljar, aluminum of approximately 100 Å thickness is put on the silver-evaporated surface of the member 38 by vacuum evaporation, and thus the signal electrode 41 is formed. Further, an inert gas such as argon is introduced into the vacuum belljar and kept under an ambient pressure of approximately 1 Torr. Then, approximately 6 mg of magnesium fluoride ($MgF_2$) is filled into an evaporating boat, and is evaporated to form the first porous layer 40 with the signal electrode 41 side facing an evaporation source at a distance of approximately 80 mm. In doing this, it is to be desired that the target supporting member 38 should be rotated to eliminate unevenness in evaporated film thickness. The first porous layer 40 formed in this manner is approximately 12 μm thick and has a bulk density of approximately 1% of the normal bulk density. Thereafter, oil or fat is burnt in the atmosphere, and the second porous layer 42 is formed on the first porous layer 40 to a thickness of approximately 3 μm by using carbon obtained by incomplete combustion of the oil or fat. Instead if burning the oil or fat, the second porous layer 42 may be formed by evaporating carbon. Like the case of the evaporation of the first porous layer 40, the target supporting member 38 as a substrate should preferably be rotated. Thus, a porous double layer is formed as shown in FIG. 2. Magnesium fluoride ($MgF_2$) and carbon (C) mixedly coexist in the boundary region between the first and second porous layers 40 and 42, lacking clearness of separation. The second porous layer 42 as a coating for the first porous layer 40 has it particles continuously distributed in point-contact manner,m having very high resistance and causing no deterioration of resolution. Thus, the second porous layer 42 of such material may rather produce better results than those obtained with use of a metal layer.

Figure 5:
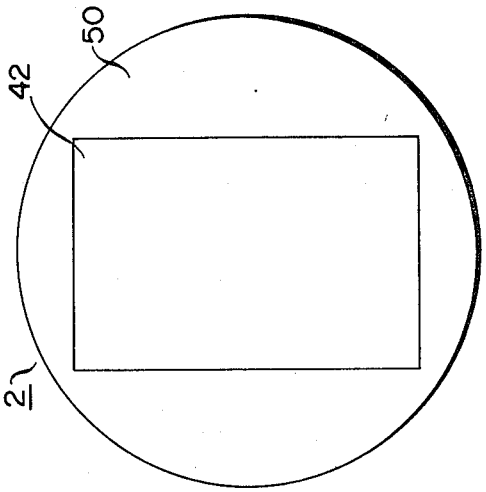
FIGS. 4 and 5 are schematic sectional and plan views of a secondary electron multiplication target according to another embodiment of the invention, respectively.
Figure 4:
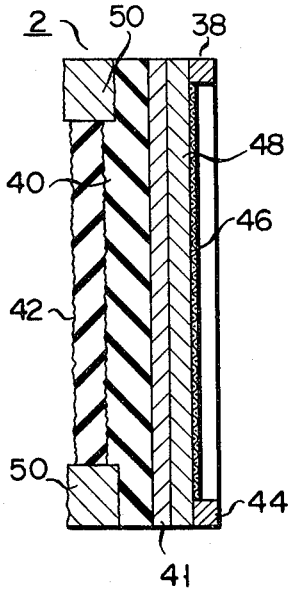

In manufacturing the target 2 as shown in FIGS. 4 and 5, the first and second porous layers 40 and 42 are previously laminated by the aforesaid process. Then, the laminated structure is located in a vacuum belljar, the vacuum belljar is exhausted to form a high vacuum, a mask corresponding to the present electron beam scanning region of the target is inserted, and silver as a metal layer 50 is stuck to a thickness of approximately 5,000 Å only on the no-scanning region of the target by evaporation. Thus, the target evaporating operation is completed. Such evaporating operation can be performed continuously by filling first and second porous layer materials and a metal layer material into evaporation sources previously set at their respective evaporation distances and providing a shutter and a mask. The peripheral portion of the evaporated region is not limited to a rectangular shape and may be circular as long as it corresponds to the no-scanning region. In the SEC target formed in this manner, as shown in FIGS. 4 and 5, a double layer combining the first and second porous layers is formed in the region corresponding to the electron-beam scanning region, while a composite layer consisting of the double layer in which the metal is penetrated and the additional metal layer is formed in the region corresponding to the no-scanning region.

The SEC vidicon incorporating the SEC target 2 according to the above-mentioned embodiment of this invention is operated as follows. An optical image is formed on the front of the photocathode 16, passed through a lens 52 (shown in FIG. 1) and the transparent face plate 12. The photocathode 16 emits photoelectrons in accordance with the intensity of incident light rays. The emitted photoelectrons are accelerated by the electrodes 18 and 20 to penetrate the first porous layer 40 of the target 2 through the supporting member 38 and the signal electrode 41 of the target 2. In the first porous layer 40, the introduced photoelectrons produce a great number of secondary electrons and positive charges while losing its energy. The produced secondary electrons are attracted by the signal electrode 41, while the positive charges remain in the porous layers 40 and 42. Such phenomenon that the secondary electrons and positive charges produced in the porous layers in this manner are stored in the target and they are discharged by electron beam is called a secondary electron conduction effect (SEC effect). Some photoelectrons pass through the first and second porous layers 40 and 42 and reach field mesh electrode 32. When the photoelectrons leave porous layers 40 and 42, a large portion of secondary electrons in the porous layers go to the signal electrode and a small portion of them go through the porous layers toward the field mesh. The transmitted secondary electrons leave positive charges in the porous layer. The phenomenon of the corresponding signal to the transmitted secondary electrons is called a transmitted secondary electron effect (TSE effect). By the TSE and SEC effects, an electron image and a positive charge image are formed in the porous layers. An electron beam emitted from the electron gun 22 is converged by the focussing electrode 30 and focussing coil 34, deflected by the deflecting coil 34, and landed on the surface of the second porous layer 42 passed through the field mesh electrode 32. Thus, positive charges stored in the position where the electron beam is landed are neutralized by the landed electrons. As a result, signal current corresponding to the neutralized positive charges is read out through the signal electrode 41.

During such operation of the SEC vidicon, the surface potential of the second porous layer 42 rises, and the crossover potential of the layer 42 is high enough to prevent the landed electron beam from further producing secondary electrons since the layer 42 is formed of a material with a low secondary electron emitting ratio. Consequently, it can be achieved to prevent the potential of the second porous layer 42 from being increased above the crossover potential, thereby protecting the target 2 from breakdown. Moreover, since the first and second porous layers 40 and 42 are formed of materials with dielectric constants of 6 or less, the target 2 will be prevented from shrinking to change its characteristics even though the target voltage applied to the signal electrode 46 becomes relatively high. According to the embodiment shown in FIG. 4, furthermore, the positive charges and secondary electrons are not stored in the non-scanning region of the target 2 which is formed of the conductive metal 50 and the double porous layers 40, 42, so that the potential of such region is high enough to prevent breakdown of the target and hence reduction of the resolution of the target 2.

With the target according to this invention, there are obtained the following dynamic characteristics.

(1) The first crossover potential in the electron-beam scanning region of the target is maintained at a sufficiently high voltage of 80 V or more.

(2) As for the resolution, it is subject to no deterioration because the resistance of the target itself is high enough.

(3) Although the second porous layer is relatively thin, e.g. 5 μm thick or thinner, good characteristics is obtained. The second porous layer is highly stable against moisture and alkaline metal vapor produced during the formation of a photoelectric surface. Thus, there would be caused no deterioration of picture quality attributable to shrinkage of the porous layer.

In the secondary electron multiplication target of this invention, as described above, a first porous layer as an original secondary electron emitting layer is combined by continuous lamination with a second porous layer with a low secondary electron emitting ratio and a dielectric constant of 6 or less. Thus, the first crossover potential can be increased while maintaining the high gain characteristic innate in the secondary electron multiplication target incorporated in an SEC vidicon, so that the picture quality or resolution can be improved, and stable, low-speed electron-beam scanning can be maintained even though the suppressor mesh is removed. Removal of the suppressor mesh from the SEC vidicon incorporating the secondary electron multiplication target of the invention produced many effects as follows:

(1) The picture quality is improved.

(2) The electrode structure in the vicinity of the target is greatly simplified.

(3) Improved pictures may be obtained without any "fog" which is conventionally causing by an image of the mesh grid projected on the picture and the secondary electrons produced from the mesh grid. This is the same effect as is obtained by smoothing the target surface.

(4) Although the stray capacity of the target is approximately 30 pF under the existence of the suppressor mesh, it is reduced to 11 pF to 12 pF when the suppressor mesh is removed. Thus, the S/N ratio of a preamplifier is improved, and the S/N ratio of a color camera using the SEC vidicon is increased from 38 dB to 42 dB.

(5) With respect to the resolution, the modulation degree response with 400 TV lines is increased from 30 through 35% to 35% or more.

Although carbon is used for the second porous layer in the above-mentioned embodiments, substantially the same effect may be obtained with use of any other material having a dielectric constant of 6 or less.

According to the secondary electron multiplication target of this invention, as stated above, the picture quality can be improved without deteriorating the gain characteristic of the porous secondary electron multiplication target.

What is claimed is:

1. A secondary electron multiplication target for a camera tube, comprising:

platelike signal electrode means formed of a conductive material, for removing secondary electrons to form a camera tube output signal;

a first porous layer consisting essentially of $MgF_2$ deposited on one side of said signal electrode for emitting secondary electrons in response to photoelectrons transmitted thereto through said signal electrode; and a second porous layer formed of carbon deposited on said first porous layer on its opposite side from said signal electrode and having a lower secondary electron emitting ratio than that of said first porous layer and a dielectric constant of 6 or less.

2. A secondary electron multiplication target according to claim 1 wherein said signal electrode is formed on a member for supporting said target.

3. A secondary electron multiplication target according to claim 2, wherein said member includes a metal ring, a metal mesh stretched across said metal ring, and a conductive thin film covering said metal mesh and having said signal electrode formed thereon.

4. A secondary electron multiplication target according to claim 1, wherein said first and second porous layers are laminated on said signal electrode, and a conductive metal layer is formed on one portion at least of the peripheral region of target, said region being not scanned by the electron beam.

* * * * *